United States Patent [19]

Prouty

[11] Patent Number: 4,724,504

[45] Date of Patent: Feb. 9, 1988

[54] RAPID TURN-ON, SLOW DROP-OUT CONTROL ARRANGEMENT

[75] Inventor: Robert E. Prouty, Logansport, Ind.

[73] Assignee: Hamilton Standard Controls, Inc., Farmington, Conn.

[21] Appl. No.: 945,142

[22] Filed: Dec. 22, 1986

[51] Int. Cl.[4] ..... H01H 47/26; H01H 9/00; H01H 50/12

[52] U.S. Cl. ..... 361/165; 361/194; 361/195

[58] Field of Search ..... 361/165, 194–196

[56] References Cited

U.S. PATENT DOCUMENTS 2,885,604 5/1959 Stavrinaki ..... 361/195
2,932,774 4/1960 Rice ..... 317/141
4,189,091 2/1980 Ballard et al. ..... 236/11
4,320,309 3/1982 Griffiths et al. ..... 307/132 T

*Primary Examiner*—L. T. Hix
*Assistant Examiner*—David Porterfield
*Attorney, Agent, or Firm*—Stephen A. Schneeberger

[57] ABSTRACT

An electrical equipment controller is provided with a delayed turn-off capability. A thermostat is in series with a control relay. The thermostat is further in parallel with the series combination of a relay latch contact and a first positive temperature coefficient (PTC) device. A second PTC device is connected in parallel with the control relay. The arrangement of first and second PTC devices provides a predeterminable drop-out relay including compensation for ambient temperature changes.

4 Claims, 2 Drawing Figures

RAPID TURN-ON, SLOW DROP-OUT CONTROL ARRANGEMENT

DESCRIPTION

1. Technical Field

The invention pertains to electrical control circuitry and particularly to electric circuitry for controlling operation of electromechanical equipment.

2. Background Art

Various types of electromechanical equipment frequently need to be controlled in accordance with operating conditions. One example of such control relates to equipment, such as a fan motor, or the like, being turned on and off at desired times. Moreover, it is sometimes desirable to provide for a delay between an initial control action and one or more of the ultimately-intended responses.

In particular, it is frequently desired to rapidly apply power to certain types of equipment and then to keep the equipment powered for a finite, determined period after a decision is made to terminate operation. Such requirements arise, for example, where thermostats are used to determine when a blower fan associated with a furnace should, or should not, be operating. For instance, in the thermostatic control of a furnace which also includes a blower, it is generally desirable to keep the blower operating for some determined interval, e.g., 60 seconds, following turn-off of the furnace by satisfaction of the thermostat. Various techniques have been employed to provide a time delay associated with the operation of power-controlling devices such as relays. In U.S. Pat. No. 4,189,091 to Ballard et al, there is disclosed a control circuit for a blower associated with a furnace. The blower is controlled by a relay which in turn possesses a time-delay capacity. The time delay is provided by a capacitor and resistor and employs relatively elaborate electronics. Moreover, the time delay appears to exist not only on drop-out of the relay, but also on pick-up.

Another form of time delay associated with a relay is disclosed in U.S. Pat. No. 2,932,774 to Rice. That electric circuit arrangement employs the positive temperature coefficient of a resistive lamp to maintain a relay energized for a brief period, i.e., ¼ of a second, following the opening of one of two possible current paths to the relay coil. Shortly thereafter, the current to the relay drops below the critical threshold value and the relay drops-out, opening the remaining current path. Additionally, that circuit is arranged such that some current may flow to the load if the switch is closed, even if the lamp is hot and the relay does not pick up.

U.S. Pat. No. 4,320,309 to Griffiths et al discloses another circuit in which a PTC resistor, rather than a lamp, is employed as a thermally-variable resistor connected in series with a relay coil for providing a time-delay function. However, that time delay is associated with a relay that cycles on-and-off automatically at predetermined time periods in the nature of an oscillator.

It is an object of the present invention to provide a control arrangement which allows power to be rapidly applied to electromechanical load equipment but which also provides a relatively slow drop-out of determinable interval following opening of a switch, such as a thermostat. Included in this object is the provision of such control circuitry which is relatively inexpensive, yet dependable. Further included in this object is the provision of such control arrangement with compensation for changes in ambient temperature conditions.

DISCLOSURE OF INVENTION

According to the invention there is provided an improved arrangement for controlling the application of electrical power to certain electrical equipment via controlled power contacts. The control arrangement includes selectively energizable relay coil means for controlling the application of electrical power to the electrical equipment via the power contacts. The relay coil means includes latch contact means controlled thereby to be either open or closed to the passage of electrical current from a power source. The relay coil means is connected in series with the latch contact means. A first PTC means is connected in series with the latch contact means. A thermostat means for responding to temperature is operatively connected in parallel with the latch contact means and the first PTC means. The control arrangement is further characterized by the inclusion of a second PTC means, which is connected in parallel with the relay coil means. The combined circuit serves to establish a determinable time delay for the de-energization of relay coil means and is relatively unaffected by changes in the ambient temperature in which the first and second PTC means are located. Each PTC means is preferably a PTC resistor.

In a preferred arrangement, the relay coil means is a singular relay coil of the two-pole type, with one set of contacts being the power contacts for the electrical equipment and the other set of contacts providing the latch contacts. If, on the other hand, the relay possesses only a single pole, that pole will be dedicated to the provision of the latch contacts and a second, single-pole relay will be connected in circuit with the first relay such that the two are energized or de-energized substantially in common.

Other features and advantages will be apparent from the specification and claims, and from the accompanying drawings which illustrate embodiments of the invention.

BEST MODE FOR CARRYING OUT THE INVENTION

Figure 1:
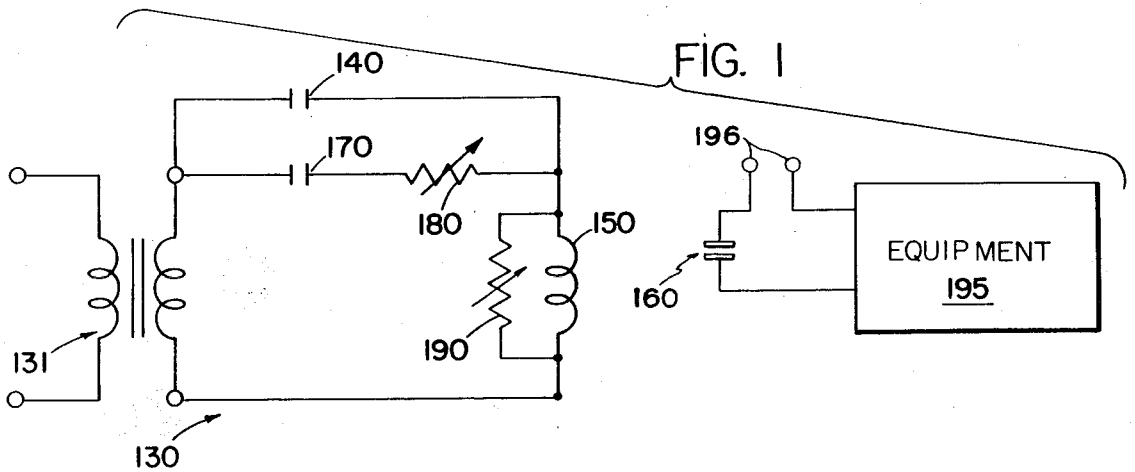
FIG. 1 shows a first embodiment of the control circuit of the invention, illustrating a pair of PTC elements arranged to provide temperature-compensated, delayed drop-out of the relay.

Referring to FIG. 1, there is depicted a relay circuit arrangement 130 according to one embodiment of the present invention. The circuit arrangement 130 is powered by line voltage through transformer 131, for example, producing 24 volts on the output side thereof. The circuit arrangement 130 includes a thermostatic switch 140 connected in series with a time-delay relay coil 150 across the 24 volt power supply. The relay which employs coil 150 is of the double pole, single throw type, with one pair of normally-open relay contacts 160 being connected in series in a supply circuit to an electric load, such as electromechanical equipment 195 which may typically be a furnace blower motor. A conventional source of power, e.g., line voltage, may be connected across the terminals 196 and causes energization of equipment 195 when the normally-open power contacts 160 are caused to close.

The other pair of contacts controlled by relay coil 150 are the normally-open latch contacts 170. Latch contacts 170 are connected in series with a PTC (i.e., positive temperature coefficient) resistor 180, and that series-combination is in turn connected in parallel with thermostat 140. In parallel with the relay coil 150 is a second PTC resistor 190. One end of the PTC resistor 190 is connected electrically in common with one end of the other PTC resistor 180 and also one side of the thermostatic switch 140.

When thermostat 140 closes, as for instance because of a thermal demand on an associated furnace, the operating voltage from transformer 131 is applied to relay coil 150, causing its energization and the resultant closing of its contacts 160 and 170. Closure of power contacts 160 serves to apply appropriate power to the equipment 195, in this instance a blower or fan motor. Such actuation of the thermostat associated with contacts 140 may also serve to energize a circuit (not shown) associated with a furnace burner (not shown).

Energization of relay coil 150 also serves to actuate latch contacts 170 to the closed position for subsequently delaying relay drop-out as will be hereinafter explained. However, during continued energization of relay coil 150 via closed thermostat contacts 140, substantially all of the current flows through the very low resistance path of the closed thermostat contacts, and relatively little current flows through the parallel path of relatively higher resistance created by closed contacts 170 and PTC resistor 180.

When a thermal demand is satisfied and the thermostat 140 again opens, a significant current begins to flow through the still-closed latch contacts 170 and the PTC resistor 180. At typical ambient temperatures, the resistance of PTC resistor 180 is in the general range of 50 ohms, e.g. 60 ohms. The increased current flow through PTC resistor 180 causes it to heat up, causing an increase in its resistance in a known manner. As the resistance of PTC resistor 180 increases, the voltage drop thereacross relative to the voltage drop across relay coil 150 correspondingly increases. This continues until such time as the voltage across relay coil 150 falls below its drop-out threshold, whereupon power contacts 160 and latch contacts 170 open and thereby place circuit 130 and the electrical equipment 195 in a nonoperating condition. That condition typically remains until such time as the thermostat 140 is again closed. During the period, 60 seconds in the exemplary embodiment, that the PTC resistor 180 is heating up to the value which finally results in the drop-out of latch contacts 170, any "chatter" of the thermostat contacts 140 will be substantially ignored. In other words, even though some chatter of the thermostat contacts 140 might occur, the contacts 160 and 170 of relay coil 150 will remain closed until completing the time delay which is principally determined by the PTC resistor 180.

Further in accordance with the invention, a second PTC resistor 190 is provided in circuit 130 and is connected in parallel with relay coil 150. PTC resistor 190 is typically of a resistance similar to that of PTC resistor 180, in this instance being approximately 40 ohms, but is preferably of a smaller mass in order to provide a more rapid thermal response. The parallel PTC resistor 190 provides compensation to the circuit 130 for changes in the ambient temperature which could otherwise affect the time-delay interval provided by series PTC resistor 180. During such time as thermostat contacts 140 are closed, the parallel PTC resistor 190 is connected across the full voltage of the secondary of transformer 131. Since its resistance is not insignificant with respect to that of relay coil 150, which has an AC impedance of 60 ohms, it will draw a small current which causes it to heat up somewhat, thereby increasing its resistance and decreasing its current draw until a point of stability is reached.

When the thermostat contacts 140 open, the voltage to the parallel PTC resistor 190 is reduced by the drop in voltage across the series PTC resistor 180. Thus parallel PTC resistor 190 cools down and its resistance similarly decreases. As the resistance of parallel PTC resistor 190 decreases, it begins to draw an increasing amount of current. Finally, the voltage drop across series PTC resistor 180 becomes so great, that, as described earlier, the voltage across relay coil 150 is insufficient to maintain contacts 160 and 170 closed any longer, and they open. The series PTC resistor 180 and the parallel PTC resistor 190 are both positioned in the same environment, as for instance on the structure containing relay coil 150, and thus both are affected by the same ambient temperature. Since the parallel PTC resistor 190 is affected by both the ambient temperature and the voltage across relay coil 150, it provides a compensating effect for the series PTC resistor 180 such that the resulting time delay is relatively independent of ambient temperature.

Figure 2:
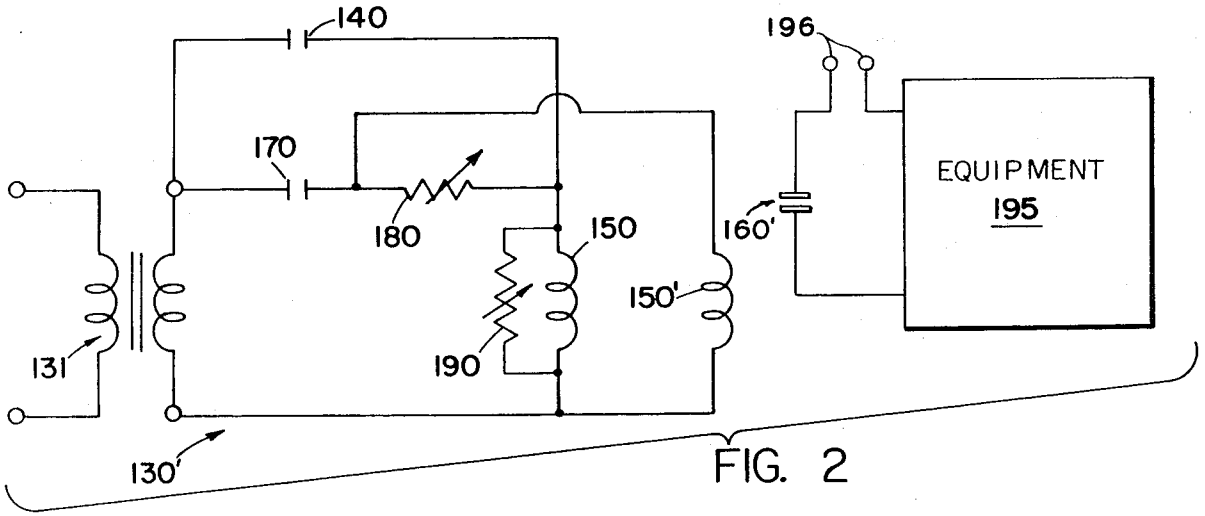
FIG. 2 shows an arrangement similar to that of FIG. 1, but in which a second relay is connected with the first relay, each relay being of only the singlepole type.

Referring to FIG. 2 there is depicted another circuit arrangement 130' which is functionally equivalent and structurally similar, but not identical, to the circuit 130 of FIG. 1. Specifically, the relay which contains coil 150 in FIG. 2 is of the single-pole type, that pole being represented by the latching contacts 170. Thus, there is need for yet another single-pole relay for controlling the power contacts 160' associated with the electromechanical equipment 195. That second relay is represented by relay coil 150' which is connected at its lower end to the lower end of first relay coil 150 and is connected at its other end to the node or junction between latch contacts 170 and series PTC resistor 180. Since relay coil 150' is electrically separated from the source voltage of transformer 131 by both thermostat contact 140 and latch contact 170 in the same manner as relay coil 150, its operation will track that of relay coil 150 identically.

Although this invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to be secured by Letters Patent of the United States is:

1. An arrangement for controlling the application of electrical power to electrical equipment (195) via power contacts (160) comprising:

selectively energizable relay coil means (150) for controlling the application of electrical power to said electrical equipment via said power contacts, said relay coil means including latch contact means (170) controlled thereby to be either open or closed to the passage of electric current from a power source (131), said relay coil means being connected in series with said latch contact means, first PTC means (180) for increasing in resistance with an increase in temperature, said first PTC means being connected in series with said latch contact means, thermostat means (140) for responding to temperature, said thermostat means being connected in parallel with said relay contact means and said first PTC means, and second PTC means (190) also for increasing in resistance with an increase in temperature, said second PTC means being connected in parallel with said relay coil, said first and said second PTC means cooperatively establishing a determinable time delay in the de-energization of said relay coil means.

2. The arrangement of claim 1 wherein the resistive values of said first and second PTC means (180,190) are of the same order of magnitude at the same ambient temperature.

3. The arrangement of claim 2 wherein the mass of said first PTC means is greater than the mass of said second PTC means, the relative resistive values and masses of said first and said second PTC means being selected to establish said determinable time delay as being in excess of 30 seconds.

4. The arrangement of claim 1 wherein said relay coil means (150,151') comprises first (150) and second (150') relay coils each having a single pole, said single pole of said first relay coil comprising said latch contact means (170) and said single pole of said second relay coil comprising said power contact means (160'), said second relay coil (150') being connected in parallel with said series connection of said first relay coil (150) and said first PTC means (180).

* * * * *